US005938016A

United States Patent [19]

Erdtmann

[11] Patent Number: 5,938,016

[45] **Date of Patent: *Aug. 17, 1999**

[54] COSMETICS RECEPTACLE

[76] Inventor: Stefan L. Erdtmann, Waldhofstrasse 120, D-47800, Krefeld, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/619,725

[22] PCT Filed: Sep. 2, 1994

[86] PCT No.: PCT/EP94/02911

§ 371 Date: Mar. 21, 1996

§ 102(e) Date: Mar. 21, 1996

[87] PCT Pub. No.: WO95/08281

PCT Pub. Date: Mar. 30, 1995

[51] Int. Cl.[6] ..... B01F 13/00

[52] U.S. Cl. ..... 206/221; 206/219; 220/495.05; 220/495.08

[58] Field of Search ..... 206/219, 221; 220/495.05, 495.08, 495.06

[56] References Cited

U.S. PATENT DOCUMENTS

| | | | |
|---|---|---|---|
| 2,728,494 | 12/1955 | Hobson | 222/386.5 |
| 3,077,262 | 2/1963 | Gaste | 206/47 |
| 3,433,712 | 3/1969 | Gerarde | 206/220 |
| 3,458,076 | 7/1969 | Babcock | 206/221 |
| 3,625,349 | 12/1971 | Muhlbauer | 206/219 |
| 3,647,386 | 3/1972 | Gilford | 206/221 |
| 3,655,035 | 4/1972 | Muhlbauer | 206/219 |
| 3,696,919 | 10/1972 | Miles | 206/221 |
| 3,739,947 | 6/1973 | Baumann et al. | 206/219 |
| 3,762,540 | 10/1973 | Baumann et al. | 206/219 |
| 3,802,669 | 4/1974 | Nohmura | 206/219 |
| 3,819,107 | 6/1974 | Ryder, Jr. | 206/219 |
| 3,841,467 | 10/1974 | Hansen | 206/219 |
| 4,550,825 | 11/1985 | Sutryn et al. | 206/221 |
| 4,632,244 | 12/1986 | Landau | 206/221 |
| 4,731,053 | 3/1988 | Hoffman | 206/221 |
| 4,994,056 | 2/1991 | Ikeda | 206/221 |
| 5,186,323 | 2/1993 | Pfleger | 206/221 |
| 5,209,505 | 5/1993 | Goncalves | 206/221 |
| 5,618,105 | 4/1997 | Baker | 206/221 |

FOREIGN PATENT DOCUMENTS

| | | |
|---|---|---|
| 343198 | 5/1904 | France . |
| 2355732 | 1/1978 | France . |
| 866084 | 2/1952 | Germany . |
| 1153864 | 9/1963 | Germany . |
| 4118225 | 12/1992 | Germany . |
| 4110299 | 2/1993 | Germany . |
| 676784 | 3/1991 | Switzerland . |

*Primary Examiner*—Joseph M. Moy
*Attorney, Agent, or Firm*—Joseph W. Berenato, III

[57] ABSTRACT

A cosmetic receptacle desired for the sale of a mixture of cosmetic components for personal use has a vessel to hold the cosmetic components and a lid. The individual cosmetic components can be thoroughly well mixed, the vessel takes the form of a flexible bag.

22 Claims, 1 Drawing Sheet

COSMETICS RECEPTACLE

Figure 1:
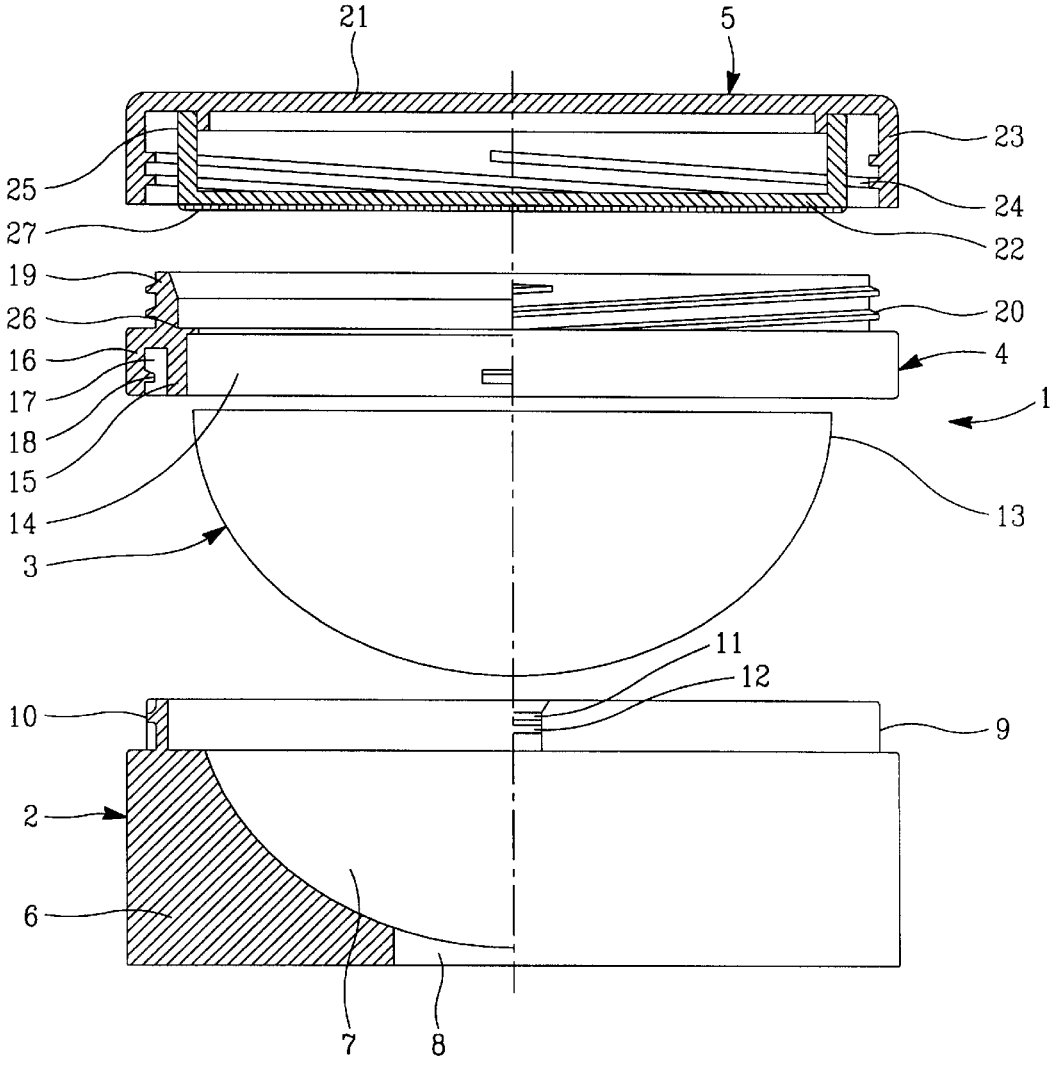

The invention relates to a process for mixing cosmetic components in which the components are put into a container pot of a cosmetics container and the container pot is closed with a closure wall and the cosmetic components are rolled around in the container pot. The invention relates further to a cosmetics container that is designed for the sale of a mixture of cosmetic components for personal use and that has a container pot, which has a filling and removal opening for holding the cosmetic components as well as a container cap and a closure wall arranged for the filling and removal opening, whereby the hand-operated mixing device for mixing the cosmetic components is provided on the container cap.

In the area of cosmetics, it is commonly known that the optimal care of the skin by means of a skin creme is only attained when the skin creme is adapted as closely as possible to the skin type and condition. To adjust to this demand, several companies offer lines of skin creme products where the individual products are differentiated from each other by their adaptation to the different types and conditions of the skin. The manufacture and marketing of such a product line is, however, only possible when the number of individual products within a product line is relatively small. For this reason, an optimally working skin creme is not available for every type of skin.

To avoid this problem, a process is suggested in DE-PS 41 10 299 wherein the skin creme is prepared specifically for the client immediately before the purchase by the end consumer at the store. For this purpose, the different cosmetic active agent components are stored separately in a series of containers. When the characteristic values of the skin of the person who will use the creme are known—the determination of the characteristic values may be provided by the buyer, or may have been provided earlier—the creme is prepared with the cosmetic components available following a pre-existing scheme or according to the process values established by the sales personnel. This is done each time by dosing the measured amounts in a cosmetic container for the use of the individual. By using this process, it is possible to adapt the skin creme optimally to each skin type and condition.

For the preparation of the skin creme, it is important that the cosmetic components added one by one into the cosmetic container be mixed in the most homogeneous distribution possible. In DE-PS 41 10 299, a cosmetics container is suggested for this purpose, which has, as is customary, a container pot for holding the cosmetic components and a screwable container cap. Additionally, the mixing means is presented in the form of one or more stirring paddles, reaching from an intermediate cap into the container pot. The cosmetic components in the container pot are mixed together by turning the intermediate cap, which causes the stirring paddles to turn.

However, a disadvantage of this cosmetics container is that an optimal mixing of the cosmetic components is not always possible with the help of the stirring paddle or paddles. This directly affects the effectiveness of the amount of creme produced each time.

Apart from this, the construction of the known cosmetics container is costly. The handling is also awkward because, with each removal of creme, the intermediate cap with the stirring paddles must be removed and stored so that the remaining skin creme adhering to the stirring paddle or paddles does not come into contact with the deposit or other objects.

In DE-C-866 084, a cosmetic container is described that has an outer container wall which is cylindrical and is open at the bottom. The opening on the bottom is closed off via a movable plate provided on the inside. On the top, the opening of the cosmetic container is covered with a disc provided with a small outlet opening. A cap is arranged on top of this disc. In the inner space of the cosmetics container, a container pot is installed that has a flexible bag with its outer edge stretched around a ring disc. The ring disc has a large opening which is coaxial to the outlet opening in the disc, which is arranged over it.

For expressing the cosmetic components contained in the bag, the cap is removed and the bottom disc is pushed upwardly. Because of the volume displacement produced by this, the mixture passes out of the opening of the ring disc and the outlet opening in the disc that lies above it.

The combination of the bag and the ring disc can be used as a refill container. In this way, the cosmetics are put in through the opening in the ring disc into the bag. Additionally, the bag is provided with a protection sleeve that has a lower protection disc to protect the bag against pressure or damage.

This cosmetic container is designed for the finished mixture, as there are no provisions made for mixing the individual components inside the cosmetic container.

Apart from this, in U.S. Pat. No. 3,077,262, a bag is disclosed that can be divided into two container sections with the help of a wedge strip, which can contain different components, such as hardening adhesive substances. For mixing the components, the wedge strip is removed and the bag is milled by hand.

The object of the invention is to develop a process for a thorough, hygienic mixing of individual cosmetic components. It is a further object of the invention to offer a cosmetics container that provides a simple means for this process.

Regarding the first part of this object, the solution consists of using an elastically stretchable bag that is compressed in the direction of the closure wall, forming squeeze splits. The invention device is characterized by the container pot forming the mixing arrangement in that it is an elastically stretchable bag built so that, by applying hand pressure to sections of the bag in the direction of the closure wall, the mixing of the cosmetic components creates effective, localized squeeze splits between each of the depressed sections of the bag and the closure wall.

Using the process according to DE-PS 41 10 299, the individual cosmetic components can be added through the filling and removal opening to the bag where a base or active substance carrier is already present, having been filled in at the factory. After the cosmetic components have been added, they are mixed by exerting pressure from the outside with the fingertips in the direction of the closure opening, so that squeeze splits are created. It has been shown that a very effective mixing of the cosmetic components can be reached in this way so that, after a very short time, a complete homogenization is obtained. At the same time, it is advantageous that the mixing is carried out without the help of stirring utensils, in a hygienic, closed-off chamber.

For an embodiment of the invention, it is proposed that the open end of the bag be closeable with a closure wall. This allows the bag to be shaped flat, whereby a reduced height of the cosmetic container is achieved. The squeeze split formation is then accomplished by fingertip pressure in the direction of the closure wall. For filling in the cosmetic components and for removing the finished mixture, the closure wall is removed. Another feature of the invention is that the closure wall runs in the direction of the edge of the bag in the inserted condition. It can also be an independent part separate from the container cap, which is connected to the holding ring for closing off the bag, for example, by screwing in. However, the closure wall can also be the container cap itself or be connected to it so that, when the container cap is set in place, the bag is also closed off from the top.

The closure wall is advantageously designed to be flat and should be covered by a cover foil or lining which repels the skin creme. This can be made of the same material that makes up the bag.

In other embodiments of the invention, it is proposed that the bag be attached around a holding ring. The holding ring can be shaped as a coat so that it forms a cylinder-shaped stand that opens at the bottom and surrounds the bag. This, however, has the disadvantage that, after emptying the holding ring shaped as a cylinder-shaped stand, a relatively large container part is left behind to dispose of. In this sense, it is more convenient to provide a cylinder-shaped stand separate from the holding ring, whereby the holding ring and the cylinder-shaped stand are connectable to each other or connected in a detachable way. Even when a detachability is not considered advantageous, technical manufacturing reasons support the separation of the cylinder-shaped stand and the holding ring. The holding ring can be reduced to a small ring on which the bag is attached in a simple manner. This is especially so in the case where the holding ring can be placed or is placed on the upper edge of the cylinder-shaped stand. Thus, there is the possibility that the cylinder-shaped stand has a vertical ring bridge, and the holding ring has a U-shaped ring that opens to the bottom and can be pulled over the ring bridge. In this way, a flat outer skin of the container is achieved.

For fixing the holding ring on the cylinder-shaped stand, back stop elements interlocking on the back are especially useful and, if possible, are distributed over the circumference. They can be shaped so that the later separation of the holding ring from the cylinder-shaped stand is possible without great use of force. To make this possible, the cylinder-shaped stand should have an opening on the bottom sufficient for allowing one or more fingers of a hand to be introduced. In this way, pressure can be exerted toward the closure wall in the direction of the opening. Instead of a stop, other connecting means can be used; for example, screwing with a thread that turns in the opposite direction of the container cap. In any case, a safety device to prevent overturning should be provided on the holder ring so that it cannot turn with the container cap when it is turned in the opening or closing direction.

In further embodiments of the invention, it is provided that the inner contour of the cylinder-shaped stand is at least partially adapted to the outer contour so that the bag leans on the inner contour of the cylinder-shaped stand when it is full. This simplifies the removal of the skin creme and protects the bag in high loading conditions, especially at its connection to the holding ring.

The outer side of the container cap is advantageously even so that it can be installed on an even surface without risk of wobbling.

For the bag, a very advantageous shape is that of an elliptical vertical section or hose. It can be preferably attached with its upper edge to the inner side of the holding ring.

The invention is further explained with reference to the drawings. They show a cosmetics container, referred to generally with numeral (1), wherein the individual parts are separated in a vertical direction and are partially represented in the vertical section.

The cosmetics container (1) has four main parts, namely—from bottom to top—a cylinder-shaped stand (2), a bag (3) for holding the cosmetic components, a holding ring (4), and a container cap (5). The cylinder-shaped stand (2), holding ring (4), and container cap (5) are made of appropriate synthetic materials or glass in stable form, while the bag (3) is elliptic and is made of bendable, limp and stretchable material, such as latex or silicon.

The cylinder-shaped stand (2) has a mostly ring-shaped body (6), which surrounds a hollow space (7) whose rotation-symmetric inner contour corresponds to the outer contour of the bag (3). It is cylindric on the outside and has an opening (8) in the middle. It is cut on the left side and shown from the right side.

The cylinder-shaped stand body (6) has a vertically extending ring bridge (9) on the upper edge, which is distributed over the circumference with stop protrusions (10, 11, 12) that protrude to the outside. The ring bridge (9) is displaced to the inside from the outside of the cylinder-shaped stand body (6).

The bag (3) hangs through downwardly, and is represented separately from the holding ring (4). In the representation of the cosmetics container (1), the upper edge (13) of the bag (3) is attached to the inner wall (14), by gluing or spraying, for example. The inner wall (14) is part of a U-shaped ring bridge (15) that extends vertically downward, which has a U-shaped ring (16) running parallel and, to a certain distance, outwardly. Both close a ring groove (17), which is open at the bottom.

The ring groove (17) is shaped in such a manner that, when the holding ring (4) is put in place on the cylinder-shaped stand (2), it can receive in it the ring bridge (9). From the inside of the outer U-shaped ring bridge (16) protrude stop protrusions (18) that complement the stop protrusions (10, 11, 12). They are formed on the outside of the ring bridge (9) and interlock on the back when the holding ring (4) is placed on the cylinder-shaped stand (2) so that the holding ring (4) is temporarily fixed on the cylinder-shaped stand (2).

The holding ring (4) shows a screw ring bridge (19) on its upper part, which is provided on its outside with thread grooves (20). The holding ring (4) is also shown on the left side in the vertical section and on the right side in the view.

The container cap (5) represented in the vertical section is built in two parts and consists mainly of a screwable cap element (21) and a closure wall (22) protruding into the inside. The screwable cap element (21) shows a downwardly protruding cylindrical cap edge (23) that is provided on the inside with thread grooves (24), which correspond to the thread grooves (20) on the holding ring (4) so that the container cap (5) can be screwed onto the holding ring (4) and can also be unscrewed from it.

The closure wall (22) has a high-standing ring wall (25) that is connected via the closure wall (22) to the inside of the container cap (5). The circumference of the closure wall (22) is measured in such a manner that, during the screwing operation, the container cap (5) is guided to the holding ring (4) and into the space encircled by the screw ring bridge (19) until the closure wall (22) comes to a stop on a heel (26) of the holding ring (4). The closure wall (22) builds a closure that allows a squeezing of the bag (3) on a plane without the interference of corners or edges. On the underside of the closure wall (22), a covering foil (27) is provided that has low clinging properties with respect to skin creme—silicon, for example.

With the help of a cosmetics container (1) of this kind, the process of DE-PS 41 10 299 is carried out in the following manner:

With the container cap (5) off, the bag (3) is first filled with a carrier medium mostly in the form of an emulsion. This can be done by the manufacturer of the cosmetics container (1) or at the store where the sale to the final consumer takes place. Then, the cosmetic components for the different skin types and conditions are chosen according to amount and kind corresponding to a pre-existing scheme and are added to the carrier medium in the bag (3). If the holding ring (4) and the cylinder-shaped stand (2) are not already separated, this is accomplished by removing the holding ring (4) from the cylinder-shaped stand (2). Before and after, the container cap (5) is screwed on the holding ring (4) so that the closure wall (22) closes the opening of the bag (3).

Additionally, a pressure in the direction of the closure wall (22) is exerted by hand on the outside of the bag (3), changing from area to area. This results in extreme currents forming inside the bag (3), leading to a mixing of the individual components. Very quickly, it can be learned what actions need to be taken from outside so that the mixing process can be more intensive and rapid.

When a sufficient mixing is reached, the unit consisting of the holding ring (4) and container cap (5) is placed on the cylinder-shaped stand (2) and fixed on it by the stop. The cosmetic container (1) is then delivered for sale to the final consumer. For removing the skin creme, the container cap (5) is screwed off so that the open side of the bag (3) is uncovered. The bag (3) is supported during this process by the inner contour of the cylinder-shaped stand body (6).

When the bag (3) is emptied, the holding ring (4) is pulled out of the cylinder-shaped stand (2). This can be done by inserting a finger through the passage hole (8) and exerting additional pressure on the closure wall (22). Thus, the stop is decoupled. After removal of the container cap (5), the bag (3) can be filled anew or—when this is not possible because of hygienic or practical reasons—can be replaced by a new unit of holding ring (4) and bag (3) and container cap (5), and this new unit can be filled with cosmetic components.

I claim:

1. A device permitting manual mixing of cosmetics, comprising:

a. an elastically expandable bag of hemispherical configuration for holding cosmetic components to be mixed, said bag having a first opening through which the components are deposited;

b. a holding device secured to said bag and having a second opening, said openings being substantially coextensive; and c. a closure removably secured to said holding device, said closure including a closure wall for closing said opening of said bag, so that pressing said bag by hand toward said closure wall produces localized squeeze splits of the components effecting mixing of the components between said bag and said closure wall.

2. The device of claim 1, wherein;

a) said flexible bag is elastically stretchable.

3. The device of claim 1, wherein;

a) said closure includes a cap; and b) said closure wall is removably secured to said cap.

4. The device of claim 1, wherein a) said closure wall is a cap.

5. The device of claim 1, wherein;

a) said closure wall is flat.

6. The device of claim 1, wherein;

a) said closure wall is covered with a material from a group consisting of a cover foil or lining.

7. The device of claim 6, wherein;

a) said bag and said material from a group consisting of a cover foil or lining are made from the same material.

8. The device of claim 1, wherein;

a) said holding device is a cylinder-shaped stand.

9. The device of claim 8, wherein;

a) an inner contour of said cylinder-shaped stand partially engaging an outer contour of said bag so that said outer contour of said bag leans against said inner contour of said stand.

10. The device of claim 1, wherein;

a) said holding device is a ring; and b) said bag is circumferentially secured to a said holding ring.

11. The device of claim 10, wherein;

a) said bag is secured to an upper edge of an inner circumference of said holding ring.

12. The device of claim 1, further comprising;

a) a stand for selectively supporting said bag, said stand including means for removably securing said holding device to said stand.

13. The device of claim 12, wherein;

a) said holding device being secured to an upper edge of said stand.

14. The device of claim 12, wherein;

a) said means removably securing said holding device to said stand is a vertical ring bridge; and b) said holding device includes a U-ring directed downwardly for engagement with said ring bridge.

15. The device of claim 14, wherein;

a) said stand and said holding ring including complimentary stop elements for interlocking said ring bridge to said U-ring.

16. The device of claim 10, wherein;

a) said holding ring including a safety element for preventing overturning of said holding ring.

17. The device of claim 12, wherein;

a) said stand being cylinder-shaped and including an opening facing downwardly.

18. The device of claim 17, wherein;

a) an inner contour of said cylinder-shaped stand partially engaging an outer contour of said bag so that said outer contour of said bag leans against said inner contour of said stand when said stand is secured to said holding device.

19. The device of claim 1, wherein;

a) an outer surface of said closure is flat.

20. The device of claim 1, wherein;

a) a vertical cross section of said bag is elliptic.

21. A method for mixing cosmetic components, comprising the steps of:

a. providing a mixing device including an elastically expandable bag for holding cosmetic components, a holding device secured to the bag, the holding device and bag each having an opening substantially coextensive, and a closure having a closure wall removably secured to the holding device;

b. depositing cosmetic components through the openings into the bag;

c. securing the closure to the holding device and thereby closing the openings with the closure wall; and d. manually pressing the bag toward the closure wall so that mixing currents are formed within the bag and thereby the components are caused to be mixed.

22. The method of claim 21, wherein the bag is of hemispherical configuration.

* * * * *